United States Patent [19]

Malvick et al.

[11] 4,025,422

[45] May 24, 1977

[54] METHOD AND APPARATUS FOR INSPECTING FOOD PRODUCTS

[75] Inventors: Arnold O. Malvick, Manteca; Wayne W. MacDonald, Oakdale, both of Calif.

[73] Assignee: Tri/Valley Growers, San Francisco, Calif.

[22] Filed: Aug. 14, 1975

[21] Appl. No.: 604,596

[52] U.S. Cl. ..... 209/111.5; 250/312; 250/338

[51] Int. Cl.[2] ..... B07C 5/34

[58] Field of Search ..... 209/111.5, 111.6, 111.7, 209/111.8; 250/316, 312, 338

[56] References Cited

UNITED STATES PATENTS

| | | | |
|---|---|---|---|
| 3,275,136 | 9/1966 | Allen et al. | 209/111.7 X |
| 3,366,236 | 1/1968 | Breazeale | 209/111.5 |
| 3,381,819 | 5/1968 | Crawford | 209/111.7 X |
| 3,467,254 | 9/1969 | Simmons | 209/111.6 |
| 3,515,273 | 6/1970 | Seaborn | 209/111.7 |
| 3,628,657 | 12/1971 | Billett | 209/111.7 |
| 3,773,172 | 11/1973 | McClure | 209/111.6 |
| 3,930,994 | 1/1976 | Conway | 209/111.5 |

*Primary Examiner*—Allen N. Knowles

*Attorney, Agent, or Firm*—Gregg, Hendricson, Caplan & Becker

[57] ABSTRACT

A method and an apparatus for inspecting food products for defects, in particular pit fragments, is described having a source of radiation, belt means for transporting the food products through the radiation and means responsive to the intensity of the radiation transmitted through the food products for segregating therefrom the defective food products.

6 Claims, 5 Drawing Figures

METHOD AND APPARATUS FOR INSPECTING FOOD PRODUCTS

BACKGROUND

The present invention relates to a method of inspecting food products and food product inspecting apparatus in general, and in particular to a method and an apparatus for detecting and segregating defective food products from acceptable food products. Still more particularly, the present invention is directed to a method and apparatus for inspecting peach halves and the like and segregating therefrom peach halves containing pits or pit fragments.

At the present time the task of inspecting peach halves for pits and pit fragments prior to canning in commercial canneries involves the employment of inspection personnel. The personnel involved are typically female personnel who stand shoulder-to-shoulder alongside of a conveyor belt on which the peach halves are transported cup-up. The term cup-up refers to the position of the pit cavity relative to the remainder of the peach half as it is being transported.

As the peach havles pass the inspecting personnel, the halves containing pits or pit fragments are removed from the conveyor belt by hand and placed on another conveyor belt or in a container for reprocessing In a typical production line, approximately 8 to 10 women (or men) are required to inspect as much as 10 tons of peach halves an hour. At present labor rates, the cost of this labor alone in a typical commercial cannery may range between $100,000 to $300,000 each season.

In addition to being costly, the task of visually inspecting tons of peach halves hour after hour is also tedious and not infrequently, despite the number of inspectors on a given inspection line, peach halves containing pit fragments are overlooked.

As is well known, a peach pit is generally almond-shaped and hard and has a rough, irregular surface. On occasion, during the pitting process, sharp pieces of the surface are chipped off as by the cutting blades which cut the peaches into halves. These pieces may remain in the peach half and may be as small as $\frac{1}{16}$ to $\frac{1}{8}$ of an inch. Because of their small size and because they frequently come from the girth or equatorial portion of the pit, they often are buried or hidden from view in the reddish fleshy portion of the peach forming the edge of the cup. When eaten, such pieces may cause serious injuries because of their sharp cutting edges and hence are of considerable concern to those in the commercial canning industry.

SUMMARY OF THE INVENTION

In view of the foregoing, principal objects of the present invention are an apparatus and method for inspecting food products for defects, in particular defects such as pits and pit fragments.

In accordance with these objects, there is provided in a preferred embodiment of the present invention a source of radiation, such as infra-red radiation, means for transporting food products through said radiation and means responsive to the intensity of said radiation for segregating those food products in which the intensity of said radiation is less than a predetermined level.

Among the above features, there is provided an endless belt means for transporting said food products and a plurality of radiation-responsive devices arranged in a plurality of parallel rows along a line transverse the belt means. For high resolution, each of the devices is individually shielded from scattered and reflected radiation for providing an output signal proportional to the intensity of radiation transmitted directly through the food products. The output of each of the devices is, in turn, coupled to a plurality of gate means for providing a control signal when the intensity of the radiation received by any one of the devices is less than a predetermined level. The control signal is applied to a segregating means such as a solenoid valve installed in a compressed air line for directing a jet of air against those food products in which intensity is reduced to said predetermined level. Associated also with the segregating means is means for detecting the presence of individual food products in the radiation.

BRIEF DESCRIPTION OF THE DRAWINGS

The above and other objects, features and advantages of the present invention will become apparent from the following detailed description of accompanying drawings of alternative preferred embodiments in which.

DETAILED DESCRIPTION

Figure 1:
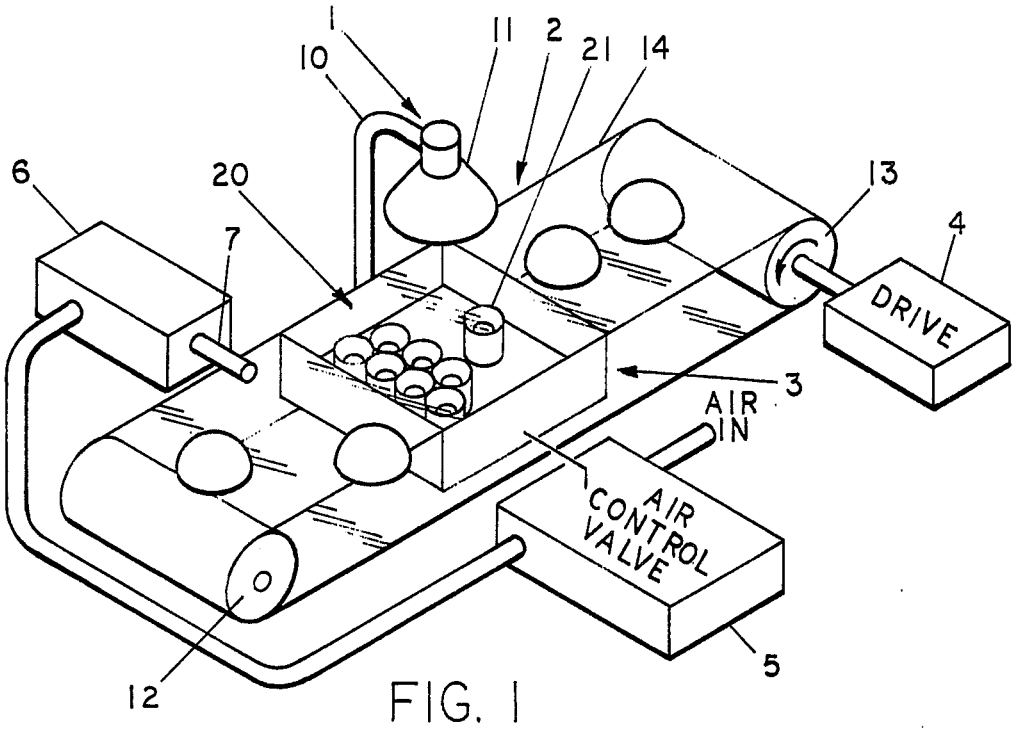
FIG. 1 is a perspective diagrammatic view of a preferred embodiment of the present invention.

Referring to FIG. 1, there is provided in a preferred embodiment of the present invention a source of radiation 1, a belt assembly 2 including a drive motor 4, an electromic assembly 3, a solenoid actuated air valve control 5 coupled to a source of compressed air an an air jet assembly 6.

Source 1 is mounted to overhand the belt assembly 2 and electronic assembly 3 as by an L-shaped hollow-tubular supporting bracket 10. Within a reflector 11 of assembly 1 is a bulb or other source (not shown) for providing infra-red radiation. Power to the bulb is provided by wires running within the bracket 10 from a conventional power source (not shown).

Belt assembly 2 comprises a pair of rollers 12 and 13, at least one of which is driven by the motor 4 for driving an endless belt 14. Belt 14 is provided to be substantially transparent to the radiation from source 1 and overrides the electronic assembly 3. Belt 14 may be supported between assembly 3 and rollers 12 and 13 in any suitable manner, such as by a planar plate, or the like (not shown). Such support, if any is required, depends on the weight of the food products to be transported on the belt, as will be described below, and on the length and weight of the belt itself.

Figure 3:
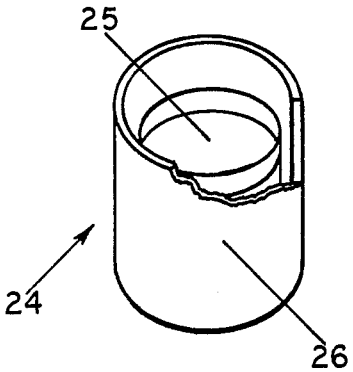
FIG. 3 is an enlarged perspective view of one of the phototransistor devices of the array of FIG. 2.
Figure 2:
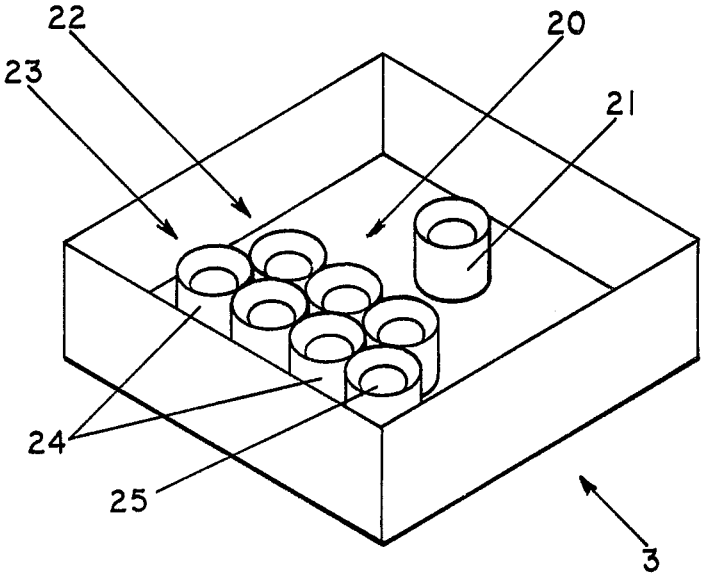
FIG. 2 is a perspective view of an array of phototransistor devices according to the present invention.

Electronic assembly 3, which, as described, is overridden by belt 14, comprises an array 20 of phototransistor device assemblies and a phototransistor device assembly 21 located in a position to the right of the array, as shown more clearly in FIGS. 2 and 3. To prevent debris from falling on the sensitive surfaces of the array 20 and device assembly 21, and to facilitate cleaning, a plate, such as a plate of glass or plastic, transparent to the radiation from source 1 (not shown), may be placed over the assembly 3 and used as a removable cover therefor.

As will be further described, air control valve 5 is coupled to assembly 3 and receives a signal from assembly 3 at appropriate times to activate the air jet 6. Air jet 6 may take any of several forms, but is essentially a means for directing a blast or jet of air from nozzle 7 for blowing a food product or the like from the belt 14 or, if desired, to merely reposition the food product on the belt.

Referring to FIGS. 2 and 3, the array 20 of phototransistor device assemblies in assembly 3 is shown comprising a plurality of adjacent rows 22 and 23 of phototransistor assemblies 24. The transistor assemblies 24 in one row are displaced laterally with respect to the transistor assemblies 24 in the adjacent row. In each of the transistor device assemblies 24, there is provided a phototransistor device 25 having a radiation-sensitive surface and a radiation shield 26. Shield 26 has an open end positioned slightly above the sensitive surface of the phototransistor device 25 or at such other height that each of the devices 25 is effectively shielded from scattered and reflected radiation. Device 21 is similarly shielded, although it is not nearly as essential since the device serves merely as a detector for detecting the presence of an object in the radiation.

While rows 22 and 23 are shown comprising, respectively, three and four of the assemblies 24, the actual number of the assemblies 24 in each row and the actual number of rows of such assemblies which are required and the amount that one of the rows is displaced relative to an adjacent row depend on the size of the radiation-sensitive surfaces of the assemblies and, in particular, on the thickness of the wall of shield 26 such that the radiation-sensitive surface of at least one of the assemblies 24 in the array underlies the path of travel of all of each peach half being transported on the belt 14.

In a typical embodiment, the top of the shields 26 is located approximately $\frac{1}{16}$ inches from the sensitive surface of the devices 25 and approximately $\frac{3}{16}$ inches from the lower surface of each peach being inspected. The size of the sensitive surface of a typical commerically available phototransistor is 0.1875 inches. The thickness of the wall of shield 26 is 0.010 inches.

While pit fragments of a size of $\frac{1}{16}$ to $\frac{1}{8}$ of an inch are of particular concern and are susceptible of detection using presently available phototransistors, it will be appreciated that there is a size of fragment below which the amount of reduction in the intensity of radiation sensed by a single phototransistor will be insufficient to generate a usable output from the device. Consequently, to detect fragments of a size less than $\frac{1}{16}$ to ⅛ of an inch, it is desirable to use phototransistor or like devices having a corresponding reduction in the size of their sensitive surfaces.

Figure 4:
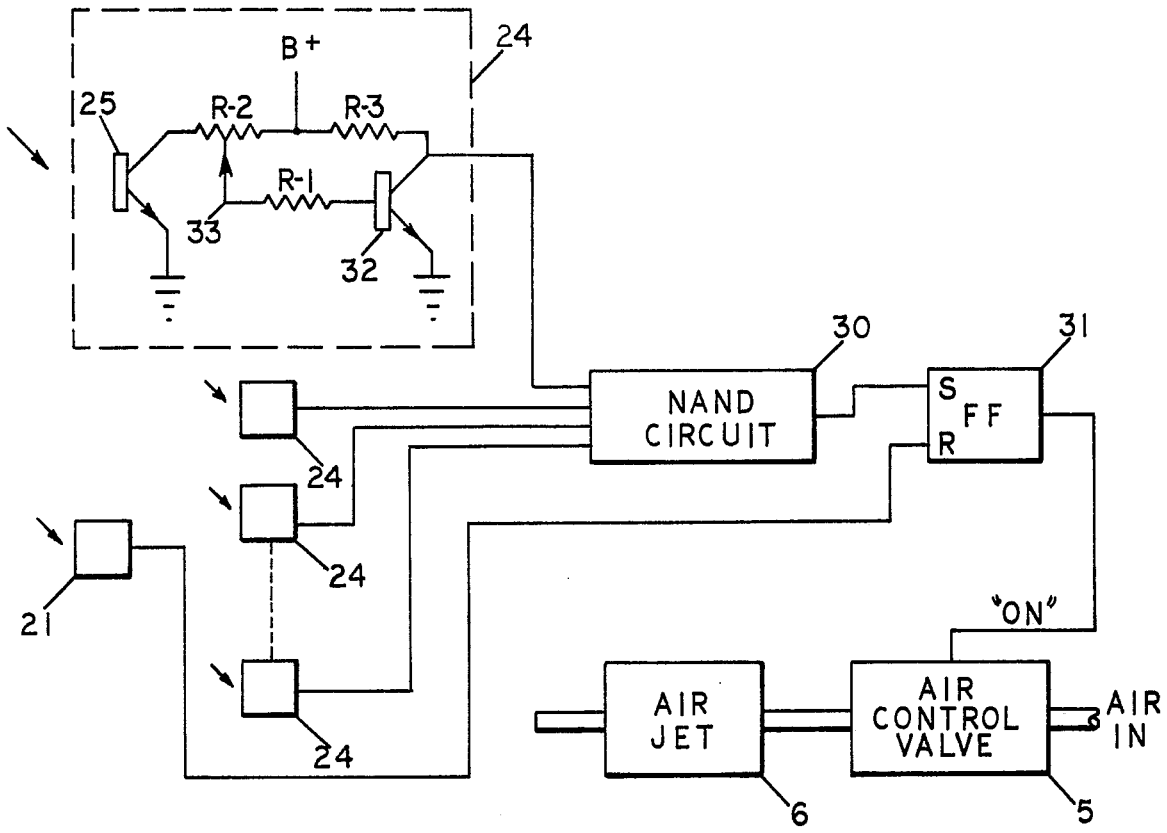
FIG. 4 is a partial schematic and block diagram of a digital control circuit including the array of FIG. 2 according to the present invention.

Referring to FIG. 4, each of the phototransistor devices 25 is coupled to one of a plurality of NAND gates constituting a NAND circuit 30, and circuit 30 is coupled to a flip-flop circuit 31. The device 21 is also coupled to the circuit 31. The output of circuit 31 is, in turn, coupled to the air valve control 5 and air jet 6.

Referring to the upper portion of FIG. 4, there is shown in detail a schematic of one of the phototransistor devices 25 coupled to a conventional driver transistor 32. Device 25 comprises an HEP 312 and transistor 32 comprises an RCA CA 3081. The base of transistor 32 is coupled through a resistor $R_1$ to the center-tap 33 of a potentiometer $R_2$ and a collector resistor $R_3$ is provided in the collector circuit of transistor 32. Adjustment of the position of the center-tap 33 provides for controlling the sensitivity of the circuit 24 to radiation from the source 1.

Figure 5:
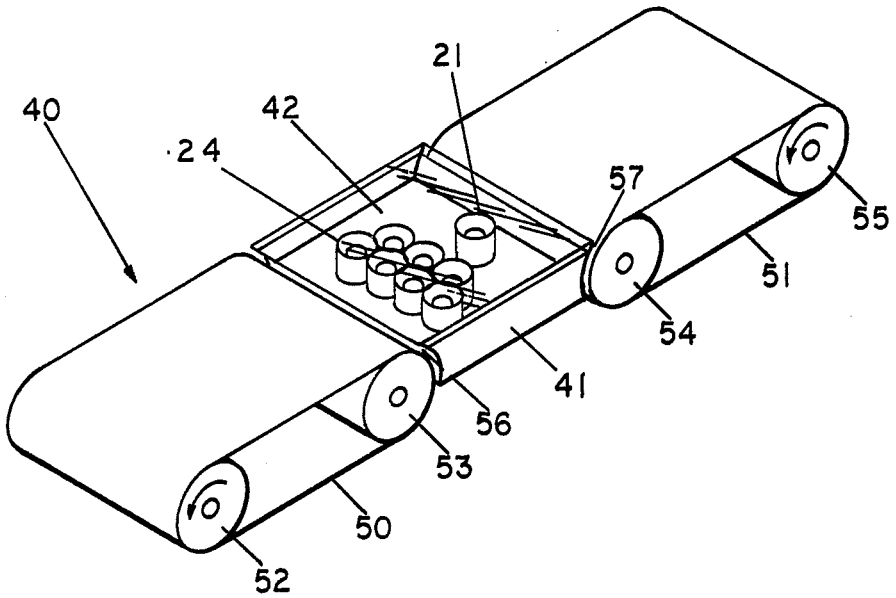
FIG. 5 is a perspective diagrammatic view of an alternative belt assembly according to the present invention.

Referring to FIG. 5, there is shown an alternative belt assembly 40 and electronic assembly 41 which may be used in lieu of the assemblies 2 and 3 of FIG. 1.

The electronic parts of assembly 41 are identical to assembly 3 of FIG. 1 in all respects but, in addition, there is provided a covering member 42 which is transparent to the radiation from source 1. While optional in assembly 3, member 42 is required in assembly 41 since it functions with the belt assembly 40 in transporting food products through the radiation from source 1.

In contrast to assembly 2, belt assembly 40 comprises a pair of spaced endless belts 50 and 51 which are supported, respectively between a pair of rollers 52 and 53, and 54 and 55. Motor means (not shown) are provided to drive each of the belts 50 and 51. Assembly 41 is positioned in the space between the belts 50 and 51 and may have a pair of exterior curved surfaces 56 and 57 adjacent to the belts for reducing the clearance spaces between the belts and the assembly. The position of the upper surface — i.e., member 42 — is preferably in the plane of the upper surface of the belts 50 and 51 to facilitate the transfer of food products from one to the other. A principal advantage of the embodiment of FIG. 5 is that the belts 50 and 51 need not be transparent to the radiation from the source 1. On the other hand, additional rollers are required.

The initial use to which the present invention has been put is in the inspecting of peach halves for pits and pit fragments. While it is clear that other food products may be inspected for defects which affect the transmission of radiation therethrough, it is believed that a description of the use of the apparatus for inspecting peach halves will be adequate to show its utility in such other uses and, accordingly, the following should be considered in that light.

Peach halves, as are well known, contain a cavity from which a pit is removed in the canning process. This cavity is called the cup. By apparatus, not shown, the halves are placed on the belt 14 of FIG. 1 or the belt 51 of FIG. 5 cup-down and transported single file through the radiation from the source 1. With the apparatus of FIG. 5, the speeds of the belts 50 and 51 are such as to cause the halves to slide across the surface 42 from the belt 51 to the belt 50.

As the halves enter the radiation, they are detected by phototransistor device 21 which resets the flip-flop circuit 31. If that half and succeeding halves are free of pits or pit fragments, they simply are transported off the left end of the belt assemblies. If, on the other hand, a pit or fragment is present in the cup, one of the phototransistor devices 25 in either of rows 22 and 23 will receive less radiation than otherwise since pits and pit fragments are more opaque to infra-red radiation than is the meat of the peach. This reduction in intensity of the radiation will result in an output from the NAND circuit 30. As is well known, a NAND circuit will provide an output when any one of its several inputs is not a predetermined level. Conversely, no output will be generated by a NAND circuit so long as all of its inputs are at a predetermined level.

An output from NAND circuit 30 sets flip-flop circuit 31, which turns on air jet 6. Air jet 6 directs a jet of air against the defective peach, removing it from the belt or repositioning it on the belt for additional processing. In any event, the defective peach half is thereby segregated from the others. It is, of course, clear that other means could also be employed for segregating defective peach halves in response to an output from the circuit 31. For instance, to eliminate the noise associated with air jets, a mechanical means such as a pusher, picker, or the like operated by a suitable electronic control activated by the circuit of FIG. 4 may be employed. In a mechanical means used for this purpose, for example, there may be provided a gate or the like which pushes or diverts a defective peach from the normal path of travel of the peaches. The defective peach may be either pushed or diverted off the side of the belt or simply repositioned on the belt and allowed to run off the end belt into a separate hopper or onto another belt for reprocessing.

While peach halves admit infra-red radiation, they are not transparent to such radiation. Consequently there is a good deal of radiation which is scattered and reflected in the meat of the peach. To avoid the possibility of a small pit fragment going undetected, the shield 26 may be made adjustable vertically to reduce the amount of scattered and reflected radiation which may be detected by any single phototransistor. Also, the sensitivity of each phototransistor circuit may be controlld by adjusting the potentiometer $R_2$. An adjustment of the potentiometer $R_2$ in each of the phototransistor circuits allows for compensating for differences in the thickness of the meat of the peach in different parts of the peach.

While a number of modifications to the embodiments disclosed have been suggested, it is understood that still other changes may be made to accommodate different applications and different food products. Accordingly, it is intended that the description of the preferred embodiments of the invention herein are to be considered only as illustrative and that the scope of the invention is to be determined not by reference thereto but by reference to the claims hereinafter provided and their equivalents.

What is claimed is:

1. An apparatus for inspecting food products for defects, comprising:

means for transmitting radiation through said food products including means for transporting food products through said radiation and including a pair of endless belts and means having a planar surface substantially transparent to said radiation located in a position intermediate said pair of belts in contiguous relation therebetween; and means responsive to a predetermined reduction of radiation transmitted through any one of a large plurality of segments of each food product for segregating said defective food product from the undefective food products.

2. Apparatus for inspecting food products for defects, comprising means for transmitting radiation through said food products, a plurality of devices responsive to radiation transmitted through said food products for providing a plurality of output signals proportional to incident radiation intensity, means responsive to a predetermined reduction of any of said plurality of output signals and to means detecting the presence of a food product in said radiation for producing a control signal including a plurality of NAND gates, each of said NAND gates having a plurality of inputs connected to separate devices and at least one output and flip-flop circuit means coupled to said NAND gates for segregating said defective food product from undefective food products by said control signal.

3. An apparatus for inspecting food products for identifying the presence of undesirable portions thereof such as pit fragments in fruit, comprising:

a source of radiation;

means for transmitting said radiation in substantially parallel rays through said food products;

a plurality of detecting means disposed to receive radiation transmitted through separate segments of each of said food products for detecting the intensity of said radiation;

means responsive to said detecting means for providing a control signal when the detected intensity of radiation transmitted through any one of said segments is less than a predetermined level;

product detection means disposed in the path of radiation and spaced from said plurality of detection means for producing a second signal during presence of a product in the path of said radiation; and means responsive to said control signal and said second signal for segregating from said food products those of said food products containing said undesirable portions.

4. A method of sensing small particles in articles, such particles having a substantially greater opacity to selected radiation than the articles themselves, the size of such particles in relation to the size of the article being such that the diminution of total radiation transmitted through the particles caused by the presence of particles is very small, said method comprising:

passing successive articles in single file along a predetermined path;

meanwhile transecting a segment of the path with selected radiation;

separately sensing radiation transmitted through a multiplicity of contiguous portions of such segment and providing a separate sensor output for each such portion;

sensing the location of each article in said segment;

sensing any diminution of radiation received by any single sensor; and actuating separating apparatus by such diminution of radiation during location of an article in said segment to separate articles having a particle therein from successive articles passing along said path.

5. Apparatus for detecting the presence of particles or the like in pieces of produce comprising:

a source producing substantially parallel rays of radiation, means moving successive pieces of produce along a path through said radiation, detecting means disposed in line with said radiation on the opposite side of said produce path from said source and including a plurality of first sensors disposed laterally across said path and a second sensor disposed in said path immediately ahead of said first sensors whereby said sensors produce signals proportional to the intensity of incident radiation, means connected to said first sensors and producing a control signal upon receipt of any sensor signal less than a predetermined minimum, gating means connected to receive said control signal and controlled by the signal from said second sensor for passing a control signal only during the presence of a piece of produce between said source and detecting means as established by said second sensor, and means responsive to said control signal as passed by said gate means for identifying pieces of produce having a particle therein.

6. The apparatus of claim 5 further defined by means connected to said first sensors including a NAND circuit for producing an output signal from any one sensor signal below a predetermined minimum, and said gating means including a flip-flop circuit having a set condition and a reset condition connected for control by the signal from said second sensor to pass a control signal only during receipt of a second sensor signal having less than a predeterminable amplitude as caused by a low incident radiation intensity from transmittal through a piece of produce.

* * * * *